United States Patent [19]

Panarelli

[11] 4,070,029

[45] Jan. 24, 1978

[54] ROLLER SKATE

[76] Inventor: Albert J. Panarelli, 8 Trowbridge Circuit, Worcester, Mass. 01603

[21] Appl. No.: 675,288

[22] Filed: Apr. 9, 1976

[51] Int. Cl.[2] ..... A63C 17/26

[52] U.S. Cl. ..... 280/11.19; 280/11.37 E

[58] Field of Search ..... 280/11.19, 11.37 E, 280/11.37 R, 11.28, 11.27, 11.2, 11.23, 11.12, 11.3, 11.17; 248/228

[56] References Cited

U.S. PATENT DOCUMENTS

| | | | |
|---|---|---|---|
| 329,581 | 11/1885 | Miller | 280/11.19 |
| 1,921,018 | 8/1933 | Whitcomb, Jr. | 280/11.19 |
| 2,502,566 | 4/1950 | Hooley | 280/11.37 E |
| 2,531,959 | 11/1950 | Woodard et al. | 280/11.37 E |
| 2,552,035 | 5/1951 | Cooke et al. | 280/11.28 |
| 2,961,269 | 11/1960 | Renfroe | 248/228 |
| 3,870,328 | 3/1975 | Gemmel et al. | 280/11.37 E |

*Primary Examiner*—David M. Mitchell

*Attorney, Agent, or Firm*—Norman S. Blodgett; Gerry A. Blodgett

[57] ABSTRACT

A roller skate having a blocking element extending between the front wheels and the rear wheels to permit its use with a hockey puck.

4 Claims, 2 Drawing Figures

ROLLER SKATE

BACKGROUND OF THE INVENTION

Interest in ice hockey has risen recently in an extraordinary manner, principally because of the introduction of professional hockey throughout the country. While interest in ice hockey was originally limited to those sections of the country enjoying ice during substantial parts of the year, it has now extended to other areas because of the extensive use of artificial ice arenas. Furthermore, organized ice hockey for young people has been promoted extensively. However, artificial ice arenas are very expensive and to many young poeple do not wish to enter the organized ice hockey leagues. Even if they did, the artificial ice available for them to use is very much limited. For that reason, there has arisen the activity of playing hockey on roller skates on a hard surface, such as an asphalt driveway. Sometimes a ball is used instead of a puck and sometimes even a puck is used. Playing hockey on roller skates, however, is limited by the fact that the skates cannot be used to move the puck the way it is in ice hockey. For instance, in ice hockey the goalie is able to provide a substantial barrier by placing his skates in alignment across the front of the goal and then placing his stick in further alignment with them. The other players are able to use their skates to manipulate the puck. These and other deficiencies of the prior art roller skates when used in playing hockey have been obviated in a novel manner by the present invention.

It is, therefore, an outstanding object of the invention to provide roller skates in which a hockey puck is not able to slide under the center of the skate between the front and the rear wheels.

Another object of this invention is the provision of a roller skate having an inexpensive way of converting it for use in playing hockey on a hard surface.

It is another object of the instant invention to provide a roller skate for use in hockey which is simple in construction, inexpensive to manufacture, and which is capable of a long life of useful purpose with a minimum of maintenance.

A still further object of the invention is the provision of a roller skate which can be used in playing hockey to manipulate the puck in the same way that an ice skate is so used.

It is a further object of the invention to provide a roller skate which has been modified for use in playing hockey but which does not interfere with its normal use as a roller skate.

It is a still further object of the present invention to provide a roller skate having a baffle element to enable it to act like an ice skate in handling a puck, but which element can be removed on occasion for use of the roller skate only in roller skating.

With these and other objects in view, as will be apparent to those skilled in the art, the invention resides in the combination of parts set forth in the specification and covered by the claims appended hereto.

SUMMARY OF THE INVENTION

In general, the invention consists of a roller skate for use in playing hockey with a puck. The roller skate has a shoe, a front wheel assembly attached to the front of the shoe, and a rear wheel assembly attached to the rear of the shoe to define a space between the rear wheel assembly and the front wheel assembly. A blocking element lies in the said space and has a lower edge located a distance above the lowermost parts of the wheel assembly, the distance being less than the thickness of a hockey puck.

More specifically, a rigid support structure is fastened to the shoe, while the first wheel assembly, the second wheel assembly, and the blocking element are separately attached to the support structure. Each wheel assembly is provided with a pair of laterally-spaced wheels and each end edge of the blocking element lies between a pair of wheels.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
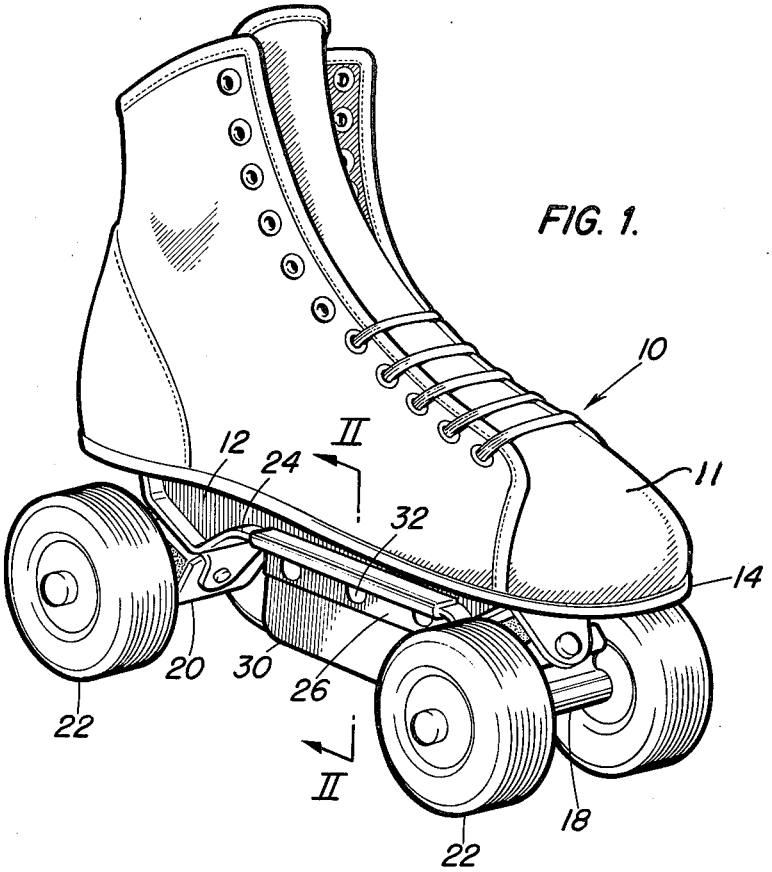
FIG. 1 is a perspective view of a roller skate embodying the principles of the present invention.

Referring first to FIG. 1, wherein are best shown the general features of the invention, the roller skate, indicated generally by the reference numeral 10, is shown as consisting of a conventional shoe 11 to the bottom of which is attached a support structure 12. The shoe is provided with a rigid sole 14 to which the support structure is attached by means of fasteners.

A front wheel assembly 18 is fastened to one end of the support structure at the toe of the shoe, while the rear wheel assembly 20 is attached to the other end of the support structure adjacent the heel of the shoe. A blocking element 30 lies in the space between the front wheel assembly 18 and the rear wheel assembly 20 and has a lower edge located a distance above the lowermost parts of the wheel assemblies. This distance is less than the thickness of a hockey puck.

Figure 2:
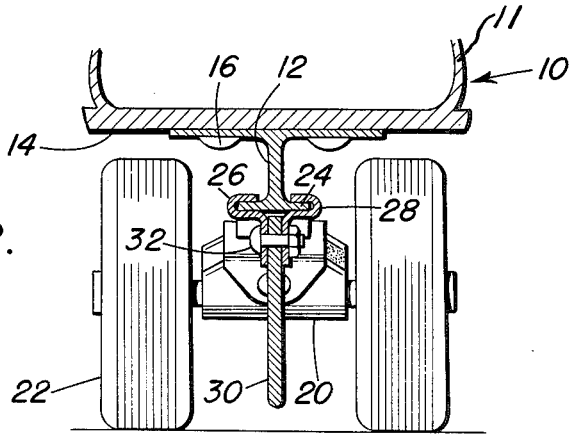
FIG. 2 is a vertical sectional view of the roller skate taken on the line II—II of FIG. 1.

As is evident in FIG. 2, the rigid support structure 12 is fastened by rivets 16 to the sole of a shoe; the front wheel assembly 18, the rear wheel assembly 20, and the blocking element 30 are all individually mounted on it. The support structure 12 is in the form of an I-beam whose upper flanges are connected to the sole of the shoe and whose lower flanges 24 are connected to the wheel assemblies and the blocking element. The blocking element 30 is in the form of a generally rectangular plate arranged vertically. One side edge constitutes the lower edge, the upper edge lies adjacent the lower flange 24 of the support structure 12, and the end edges lie adjacent the wheel assemblies. More specifically, the front and rear edges of the blocking rear element lie between the wheels 22 of the front wheel assembly 18 and the wheels 22 of the rear wheel assembly 20.

Referring to FIG. 2, it can be seen that a clamp, consisting of clamp elements 26 and 28, is mounted on the upper edge of the blocking element 30 to grasp the lower flange 24 of the support structure 12. The two elements 26 and 28 are concave and are opposed to engage the opposite edges of the flange. The elements lie on opposite sides of the plate and are drawn together to clamp the flange by means of a plurality of bolts 32 passing through the elements and the plate. The plate constituting the blocking element lies exactly under the center line of the shoe, therefore, and its bottom edge is rounded. Each of the elements 26 and 28 making up the clamp consists of a vertical section adapted to lie against the surface of the plate, an intermediate section extending upwardly at a right angle to the lower section to lie against the lower surface of the flange, and an end portion extending back from the intermediate section parallel to and spaced from the intermediate section to lie against the upper surface of the flange.

The operation of the invention will now be readily understood in view of the above description. The roller skate can, of course, be used without the blocking element 30 and, in such case, it operates as an ordinary roller skate. In order, however, to play hockey with it, the clamp elements 26 and 28 are applied to the bottom flange 24 of the support structure 12. The bolts 32 are then tightened up and the roller skate is ready for use. The user is then able to use the roller skate just as he would a regular ice skate. Not only can the entire skate be used for blocking a puck, but it also can be used for manipulating it. In blocking the entire side area of the roller skate is available. The puck may hit the side of the wheels 22 on either the front wheel assembly 18 or the rear wheel assembly 20, or it may strike the blocking element 30. Since the blocking element 30 has its lower edge residing closely adjacent the floor (as is best evident in FIG. 2), the puck is not able to slide under the roller skate. In order to manipulate the puck, the user can trap it with the roller skate with the puck pressing against the blocking element 30 and then can pass it to one of his teammates rather than use the hockey stick. On the other hand, he can trap it, kick it forward into position to be used with the hockey stick, and then the stick can be used for passing or shooting. In this way, all of the manipulations available in the use of ice skates in ice hockey are available in the use of roller skates in playing roller hockey.

It can be seen that the present invention offers many advantages over the prior art. For one thing, the person using the roller skate does not feel that he is being handicapped in any way because he does not have on ice skates. As a matter of fact, there are some manipulations with the puck that are available to him that are not available to a person using ice skates. The apparatus is inexpensive and rugged and presents no danger to the user. Furthermore, it can be easily removed and stored in order to permit the user to use his roller skate in the conventional way. The blocking element presents no danger to one of the other players, since its edges are totally enclosed within the four corners of the wheel assemblies.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A roller skate for use in playing hockey with a puck, comprising:

a. a shoe, b. a front wheel assembly having an axis and being attached to the front of the shoe, c. a rear wheel assembly having an axis and being attached to the rear of the shoes to define a space between the rear wheel assembly and the front wheel assembly, d. a solid blocking element lying in the said space and having a lower edge located a substantial distance below the axes of both wheel assemblies, the distance from the said lower edge to the ground being less than the thickness of the puck, a rigid support structure being fastened to the shoe, the first wheel assembly, the second wheel assembly, and the blocking element being separately attached to the support structure, the support structure being in the form of an I-beam whose upper flanges are attached to the shoe and whose lower flanges are attached to the wheel assemblies and the blocking element, the blocking element being a generally rectangular plate arranged vertically with one side edge constituting the said lower edge, with the upper edge lying adjacent the lower flanges of the support structure, and with the end edges lying adjacent the wheel assemblies, and e. a clamp mounted on the upper edge of the blocking element to grasp the lower flanges of the support structure, the clamp consisting of two opposed concave elements each of which engages the edge of a flange, the elements lying on opposite sides of the plate and are drawn together to clamp the flanges by a plurality of bolts passing through the elements and the plate.

2. A roller skate as recited in claim 1, wherein each wheel assembly is provided with a pair of laterally-spaced wheels, and wherein each end edge of the blocking element lies between a pair of wheels.

3. A roller skate as recited in claim 1, wherein the plate lies under the centerline of the shoe, and wherein the bottom edge of the plate is rounded.

4. A roller skate as recited in claim 3, wherein each element of the clamp consists of a vertical lower section to lie against the surface of the plate, an intermediate section extending outwardly at a right angle to the lower section to lie against the lower surface of the flange, and an end portion extending back from the intermediate section parallel to and spaced from the intermediate section to lie against the upper surface of the flange.

* * * * *